US005606885A

United States Patent [19]

Baensch et al.

[11] Patent Number: 5,606,885

[45] Date of Patent: Mar. 4, 1997

[54] DEVICE FOR THE GUIDING AWAY COLD-ROLLED TUBES BEHIND A COLD PILGER ROLLING MILL

[75] Inventors: Michael Baensch, Mönchengladbach; Wilfried Schrey, Viersen, both of Germany

[73] Assignee: Mannesmann Aktiengesellschaft, Düsseldorf, Germany

[21] Appl. No.: 364,653

[22] Filed: Dec. 27, 1994

[30] Foreign Application Priority Data

Dec. 27, 1993 [DE] Germany ..... 43 44 942.5

[51] Int. Cl.[6] ..... B21B 39/16

[52] U.S. Cl. ..... 72/250; 72/214

[58] Field of Search ..... 72/208, 214, 250, 72/428

[56] References Cited

U.S. PATENT DOCUMENTS 2,942,505 6/1960 Holmquist ..... 72/428

4,005,595 2/1977 Gerretz et al. ..... 72/250

*Primary Examiner*—Lowell A. Larson

*Assistant Examiner*—Thomas C. Schoeffler

*Attorney, Agent, or Firm*—Cohen, Pontani, Lieberman, Pavane

[57] ABSTRACT

A device for guiding away a cold-rolled tube from a cold pilger rolling mill that at least one of intermittently feeds and rotates the tube. The device including a constant-speed driver for drawing the tube from the rolling mill. The driver is arranged downstream of the rolling mill so that there is a buffer zone between the driver and the rolling mill. Additionally, an apparatus is arranged in the buffer zone for diverting the tube out of a roll direction by restrictively guiding the tube so that the tube describes a roughly S-shaped path in the buffer zone whereby cyclically non-uniform rolling speed of the rolling mill is compensated for.

7 Claims, 2 Drawing Sheets

DEVICE FOR THE GUIDING AWAY COLD-ROLLED TUBES BEHIND A COLD PILGER ROLLING MILL

BACKGROUND OF THE INVENTION

1. Field of the Invention

The invention relates to a device for guiding away cold-rolled tubes behind a cold-pilger rolling mill with intermittent feeding and/or rotating of the tube. The tube is diverted out of the rolling direction in a buffer zone between the rolling zone and a driver operating at a constant speed in order to compensate for the cyclically non-uniform rolling speed.

2. Discussion Of the Prior Art

From the generic document DE 31 46 284 C2, a process and a device are known for guiding away cold-rolled tubes of long length behind a rolling mill with a rolling stand that moves back and forth and has within it forcibly driven grooved rollers with intermittent feeding and/or rotating of the tube in the area of one or both dead center(s), whereby the alternating rotations are equally large in each rotation direction. The known process calls for the cyclically non-uniform feeding/exit speed of the rolled tube, which is typical of cold pilger rolling mills with rolling stands that move back and forth, to be changed into a constant run-out speed in a buffer zone while the tube is conducted by a drive apparatus operating at a constant speed at a distance from the rolling zone. The drive apparatus is located at such a distance that the torsional stresses in the tube do not exceed the yield strength of the tube.

The known solution is based on a known problem in cold pilger rolling mills, namely, that in the case of longer tube lengths, the entire tube length must continually be accelerated and braked during the cyclical feed, whereby the acceleration forces necessary for this must be produced by the forming process. These accelerative and decelerative forces are usually transmitted by the clamping chucks (clamping slots, run-in clamping chucks, and run-out clamping chucks) and, as applicable, an additionally present tube brake. Even in tubes of lengths starting at approximately 90 meters, accelerations of over 10 g occur, which increase as the tubes become longer and finally may lead to the tube moving forward in uncontrolled fashion in the rolling direction during its deceleration phase, i.e., to the occurrence of an unwanted feed. The deceleration forces which must be produced in order to arrest the tube depend, among other factors, on the mass of the finished tube to be decelerated and on the number of strokes of the cold pilger rolling mill.

Another problem is that it is necessary, particularly during the rolling of copper tubes, to reduce the number of strokes of the cold pilger rolling mill when the tube being rolled at a particular moment has left the first of the arresting elements, namely the clamping slots. When the tube has, in addition, left the run-in clamping chucks, the number of strokes must be reduced again. The higher the number of strokes during normal operation, the greater the effect this reduction in the number of strokes will have on the total achievable production of the cold pilger rolling mill. This is especially true when the nominal number of strokes is to be increased through other measures.

It has already been suggested in the generic document mentioned previously that, in order to limit the masses to be accelerated and decelerated, the length of the tube which is located behind the buffer zone existing between the rolling zone and the driver be dynamically decoupled from the remaining tube mass, so that only the mass of tube still remaining in the buffer zone needs to be cyclically moved. The design of the known solution calls for the tube to be diverted from the rolling plane following a straight run-out segment approximately 30 meters in length and to be introduced into the drive apparatus in a curvature of approximately 15 meters radius at a diversion of approximately 70 degrees.

In practice, it has been shown that a large diversion of this sort from the rolling axis leads, in almost all cases, to significant space problems which rule out the use of the known device.

SUMMARY OF THE INVENTION

Accordingly, it is an object of the present invention to provide, starting from the known process and the known device, an improved device which, while requiring less space, allows the buffer zone to be adjusted to the variable parameters which depend on tube diameter and tube material.

Pursuant to this object, and others which will become apparent hereafter, one aspect of the present invention resides in a device in which the diversion of the tube is restrictively guided so as to occur in an S-shaped fashion. Surprisingly, it has been found that a buffer zone with a uniformly curved run-out with a large radius is not required for the decoupling of the large tube masses behind the driver, but that instead parallel displacement of the tube in the area between the cold pilger rolling mill and the driver is sufficient, if the tube is curved in this area in an S-shaped fashion. In this area, the tube, while being subjected to accelerations and decelerations, changes its position and thus its bending line in such a way that, between the positions of maximum acceleration and maximum deceleration, the length of finished tube which emerges during this period in addition to the average tube exit rate finds room in the then longer bending line. Such a device, in which the tube is restrictively guided in an S-shaped manner according to the invention, requires considerably less space than is required by the solution according to DE 31 46 284 C2 and can therefore also be integrated without any problem into existing units.

According to another embodiment of the invention, the diversion occurs in alternating directions with repeated deviations. In this variant, too, the finished tube lengths to be temporarily stored can be stored in the multiply curved bending line of the tube without the unit taking on impractical dimensions. Because the run-out, according to the invention, of a cold pilger rolling mill requires different diversions of the tube for particular production parameters, such as the number of strokes, the finished tube lengths per stroke, the finished tube size and the finished tube material, it is possible according to another feature of the invention to adjust the restricted guide for the diverted tube. This adjustability allows the buffer zone to be matched to a great variety of production parameters, in order to achieve an optimal effect.

Pursuant to the invention, the diversion of the tube can occur at an adjustable guide wall, which is within a guide channel that is closed on at least three sides, that can be set across the guide channel in the direction of diversion of the tube. This solution permits the bending lines necessary for each particular tube to be obtained.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1A:
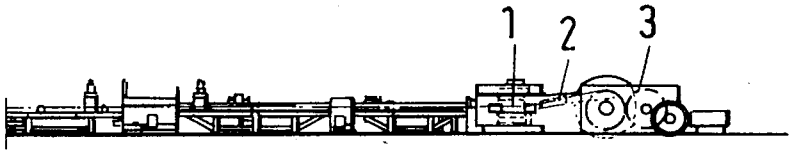
FIGS. 1*a* and 1*b* show a cold pilger rolling mill with a buffer zone according to the invention.
Figure 1B:
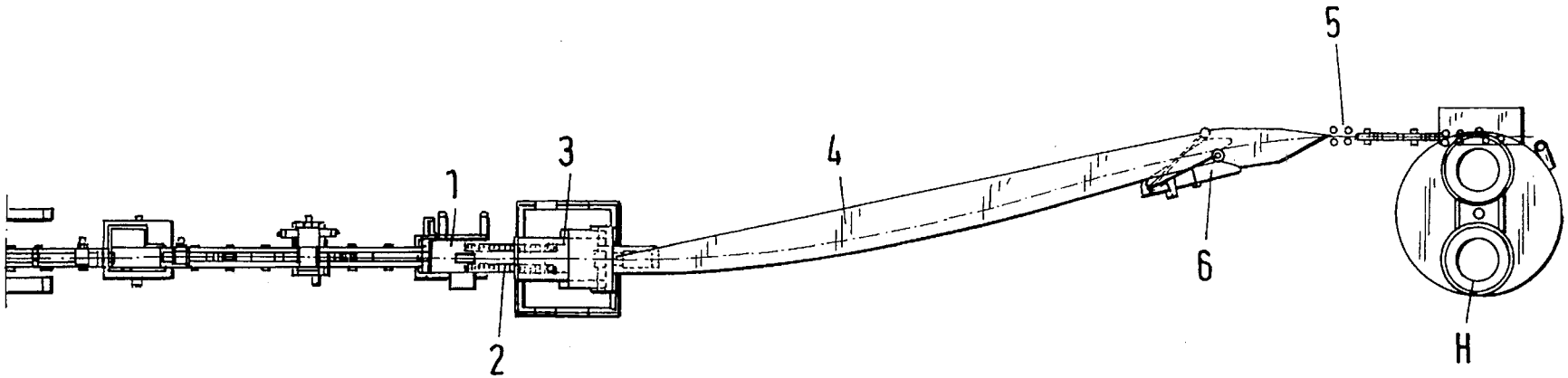

In FIGS. 1*a* and 1*b*, a cold pilger rolling mill 1 is driven via push rods 2 by a drive 3, having gearing and counterbalance, so that the rollers of the cold pilger rolling stand 1 roll on the tube. In each of the dead centers of the cold pilger rolling stand 1, the tube is rotated around its longitudinal axis in a known manner and is pushed forward to a particular extent that is determined by the length of the groove of the rollers. Each forward push means that the tube leaving the rollers of the cold pilger rolling mill 1 is accelerated on the feed path and must be decelerated in order to be stopped. Particularly in the case where large tube lengths have already left the cold pilger rolling mill, there are very large masses to be accelerated and decelerated. The size of this mass can be limited when the emerging tube is taken hold of behind a buffer zone 4 by a driver 5, which transports the tube at a constant speed, corresponding to the average run-out speed of the tube from the cold pilger rolling stand 1, and while doing so accommodates the intermittent forward movement of the tube in the buffer zone 4. According to the invention, this buffer zone is designed so that there is an S-shaped curvature of the tube. The bending line of the S-curved tube can be changed in this buffer zone 4, and specifically changed to such an extent as to accommodate the cyclically fluctuating changes in finished tube length in the S-shaped section of tube.

As FIG. 1*b* clearly shows, the subsequent coiler H is arranged in line behind the cold pilger rolling stand 1; i.e., the tube is diverted parallel to and only slightly away from the rolling line. In this way, the large deviation radii of the prior art, which require a great deal of space, are avoided, without negatively impacting the storage of the tube length cyclically exiting the cold pilger rolling stand. Naturally, instead of the coil, it is also possible to provide a straight run-out for the tubes from the driver 5.

Figure 2:
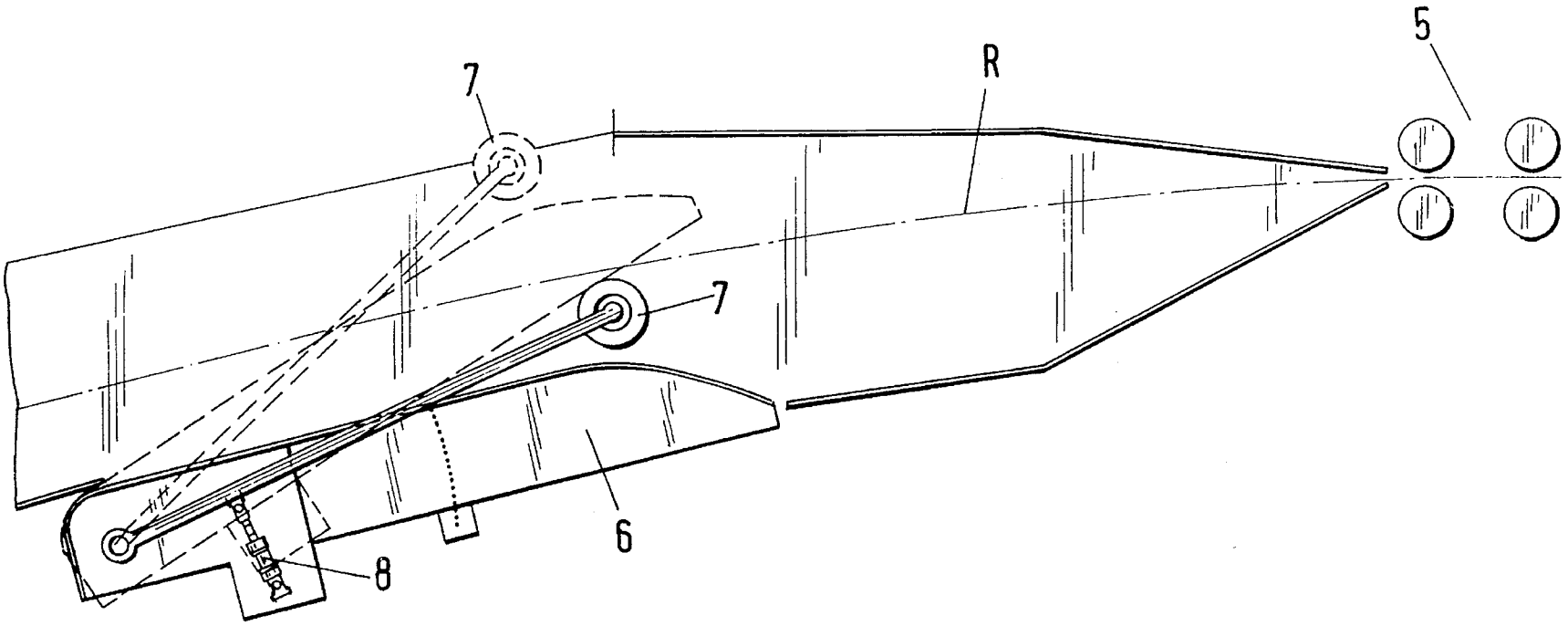
FIG. 2 is an enlarged depiction of the adjustable guide wall inside the buffer zone.

In order to be able to adjust the device to various production parameters, the buffer zone 4 is designed as a guide channel that is closed on at least three sides, into which an angularly adjustable guide wall 6, which is described in more detail in reference to FIG. 2, can be integrated. The guide wall 6, together with a guide roll 7 connected to one end of the guide wall 6 by a shaft, can be adjusted for the tube R with the help of a piston-cylinder unit 8, with the final setting being indicated by a broken line. The shaft of the guide roll 7 is mounted on a common pivot axis with the guide wall 6 and is at an angle to the guide wall so that the guide roll is between the guide wall and the tube. Depending on the setting of the guide wall 6, various bending courses of the tube can be set, which in turn display different buffer effects for different tubes.

The driver 5 is suitable for withdrawing the finish-rolled tube from the cold pilger rolling mill 1 without the tube end making disruptive whipping movements, as can be the case in the prior art. In addition, the driver 5 permits even very short tubes to be fed to downstream devices, such as coilers H, for example. Finally, the driver 5 can also be used as an additional element for compelling uniform movement of the finished tube in the event that slight deviations occur from the set parameters. In each case, it is necessary to precisely control the rate (speed) of the driver 5, as is also the case in the prior art.

However, it is also conceivable to use the driver 5 to automatically correct the guide wall 6, whereby the speed of the tube measured over one roll can serve as the guide variable, for example.

The operation of the illustrated device is as follows. The beginning of the tube is conducted through the guide channel 4 and is detoured by the guide wall 6. The guide wall 6 is set in the position shown in FIG. 2 (indicated by solid lines) and is swung into the position indicated by broken lines as soon as the beginning of the tube has passed the guide wall 6. As the process continues, the beginning of the tube is conducted through the guide channel 4 into the run-out and is taken hold of by the driver 5. During the rolling operation, the tube constantly changes its S-curved bending line to store its cyclically occurring tube lengths, with uniform withdrawal of the tube by the driver 5.

As soon as the tube is finish-rolled, it is completely withdrawn from the cold pilger rolling stand and the buffer zone 4 by the driver 5. At the moment when the tube end emerges from the cold pilger rolling mill 1, the guide wall 6 can be moved slowly back into its initial position (indicated by solid lines), so that the tube achieves an extended position.

The invention is not limited by the embodiments described above which are presented as examples only but can be modified in various ways within the scope of protection defined by the appended patent claims.

We claim:

1. A device for guiding away a cold-rolled tube from a cold pilger rolling mill that at least one of intermittently feeds and rotates the tube, comprising: a constant-speed driver for drawing the tube from the rolling mill, the driver being arranged downstream of the rolling mill so as to form a buffer zone between the driver and the rolling mill; and, means, arranged in the buffer zone, for diverting the tube out of a roll direction by restrictively guiding the tube so that the tube describes a roughly S-shaped path in the buffer zone whereby cyclically non-uniform rolling speed of the rolling mill is compensated for.

2. A device as defined in claim 1, wherein the diverting means is operative to divert the tube in alternating directions with multiple deviations.

3. A device as defined in claim 1, wherein the diverting means is operative to adjust the restrictive guiding of the diverted tube.

4. A device as defined in claim 1, wherein the diverting means includes a guide channel closed on at least three sides and an adjustable guide wall arranged within the guide channel to be adjustable across the guide channel in a direction in which the tube is to be diverted.

5. A device as defined claim 4, wherein the diverting means further includes a piston-cylinder unit arranged and adapted to adjust the guide wall.

6. A device as defined in claim 5, wherein the adjustable guide wall is adapted to pivot at one end about a vertical axis.

7. A device as defined in claim 6, and further comprising a guide roll mounted to the vertical axis of the guide wall by a shaft member so that the guide roll and guide wall pivot together, the shaft of the guide roll being arranged at an angle from the guide wall so that the guide roll is between the guide wall and the tube.

* * * * *